US008936490B2

(12) United States Patent
Hsu

(10) Patent No.: US 8,936,490 B2
(45) Date of Patent: Jan. 20, 2015

(54) ADUSTABLE POWER PLUG, ELECTRONIC DEVICE HAVING THE SAME, AND HOLDER THEREOF

(75) Inventor: Jung-Hui Hsu, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 244 days.

(21) Appl. No.: 13/481,841

(22) Filed: May 27, 2012

(65) Prior Publication Data

US 2013/0040479 A1 Feb. 14, 2013

(30) Foreign Application Priority Data

Aug. 12, 2011 (TW) ..... 100128956 A

(51) Int. Cl.

| | |
|---|---|
| ***H01R 25/00*** | (2006.01) |
| ***H01R 35/04*** | (2006.01) |
| ***H01R 24/30*** | (2011.01) |
| *H01R 103/00* | (2006.01) |

(52) U.S. Cl.

CPC ..... *H01R 35/04* (2013.01); *H01R 24/30* (2013.01); *H01R 2103/00* (2013.01)

USPC ..... 439/655; 439/103; 439/173; 439/518

(58) Field of Classification Search

USPC ..... 439/103–104, 172–173, 518, 655

See application file for complete search history.

(56) References Cited

U.S. PATENT DOCUMENTS

| | | | | |
|---|---|---|---|---|
| 1,485,193 | A | 2/1924 | McKay | |
| 3,733,576 | A * | 5/1973 | Cooper | 439/103 |
| 3,958,849 | A * | 5/1976 | Blairsdale | 439/104 |
| 4,201,431 | A * | 5/1980 | McDonald | 439/103 |
| 5,613,863 | A * | 3/1997 | Klaus et al. | 439/131 |

(Continued)

FOREIGN PATENT DOCUMENTS

| | | |
|---|---|---|
| CN | 1101461 A | 4/1995 |
| CN | 2293903 Y | 10/1998 |

(Continued)

OTHER PUBLICATIONS

China Patent Office, Search Report issued on Jun. 30, 2014.

*Primary Examiner* — Truc Nguyen

(74) *Attorney, Agent, or Firm* — Li & Cai Intellectual Property (USA) Office

(57) ABSTRACT

The instant disclosure relates to an adjustable power plug, which includes an insulating base, a pair of first pins, and a second pin. The insulating base has a main portion and a central portion movably engaged thereto. The main portion and the central portion are linearly movable with respect to each other. The first pins are disposed on the main portion, while the second pin is disposed on the central portion. When the main portion and the central portion are displaced with respect to each other, the second pin remains parallel to the first pins. The first and second pins may be arranged in an operating state or a non-operating state. The instant disclosure also discusses an electronic device having the adjustable power plug and a holder for accommodating the plug.

18 Claims, 5 Drawing Sheets

(56) References Cited

U.S. PATENT DOCUMENTS

| | | | | |
|---|---|---|---|---|
| 5,906,509 | A * | 5/1999 | Wu | 439/518 |
| 6,171,129 | B1 * | 1/2001 | Phillips | 439/346 |
| 6,328,581 | B1 | 12/2001 | Lee | |
| 6,419,504 | B1 * | 7/2002 | Nelson | 439/103 |
| 6,638,113 | B2 * | 10/2003 | Kajiwara et al. | 439/651 |
| 7,287,994 | B1 * | 10/2007 | Liao | 439/172 |
| 8,382,526 | B2 * | 2/2013 | Chen et al. | 439/655 |
| 2006/0046541 | A1 | 3/2006 | Bbutani | |
| 2011/0053410 | A1 | 3/2011 | Namiki et al. | |

FOREIGN PATENT DOCUMENTS

| | | | |
|---|---|---|---|
| CN | 2731790 | Y | 10/2005 |
| GB | 2381669 | A | 5/2003 |
| GB | 2417141 | A | 2/2006 |
| GB | 2436465 | A | 9/2007 |
| GB | 2436899 | | 10/2007 |
| TW | M299942 | | 10/2006 |
| WO | WO 01/47071 | A1 | 6/2001 |
| WO | WO 2009/152631 | A1 | 12/2009 |
| WO | WO 2010/089356 | A1 | 8/2010 |

* cited by examiner

ADUSTABLE POWER PLUG, ELECTRONIC DEVICE HAVING THE SAME, AND HOLDER THEREOF

BACKGROUND OF THE INVENTION

1. Field of the Invention

The instant disclosure relates to an adjustable power plug, an electronic device having the same, and a holder thereof; more particularly, to an adjustable power plug having a plurality of conductive pins, an electronic device fitted with the adjustable power plug for power connection, and a holder for storing the adjustable power plug.

2. Description of Related Art

For connecting to a power source, electrical devices usually utilize a power plug. However, conventional power plugs are fixed geometrically, which is inconvenient for portable applications.

Power plugs are a must-have component for making electrical connection between the electronic devices and the power source. As today's electronic devices become more compact and miniaturized, how to reduce the size of the power plug is under scrutinization as well.

Taking a three-pin plug as an example, which have two current-carrying pins and a grounding pin. The pins are arranged in a triangular pattern. When this type of power plug is received by the electronic device, a relatively large receiving space must be provided by the electronic device. Such limitation increases the overall size of the electronic device and reduces its portability.

Space-saving type power plugs already exist, as taught by the following Pat. Nos.: U.S. Pat. No. 6,328,581, GB2381669A, GB2417141A, GB2436465A, GB2436899A, U.S. Pat. No. 1,485,193, WO0147071A1, WO2009152631A1, WO2010089356A1, WO2006046541A1.

However, when designing a space-saving type power plug, country-dependent safety standards must be satisfied. For example, one of the safety standards specify that the current-carrying pins and the grounding pin must be parallel to one another. Although the aforementioned Pat. No. GB2436899A (also published as CN101461104A) titled "Electrical Plug with Movable Pin, and Two-pin Adapter" provided a smaller power plug through a rotating mechanism, the pins were not always parallel to one another. Thereby, the safety criterion was not satisfied. The ability to provide a space-saving type power plug while meeting all the safety standards is greatly desired.

SUMMARY OF THE INVENTION

The object of the instant disclosure is to provide a space-saving type power plug, which addresses the portability issue while maintaining the current-carrying pins and the grounding pin at a parallel configuration (i.e., along the long side of the pins) at all time.

The adjustable power plug of the instant disclosure comprises an insulating base, a pair of first pins, and a second pin. The insulating base has a main portion and a central portion movably engaged thereto. The main portion and the central portion may move linearly relative to each other. The first pins are arranged on the main portion, while the second pin is disposed on the central portion. When the main portion and the central portion move with respect to each other, the second pin remains parallel to the first pins in a direction along the long side of the pins. Thus, the first pins and the second pin may be arranged at an operating state or a non-operating state.

The other object of the instant disclosure is to provide an electronic device equipped with an adjustable power plug. The adjustable power plug occupies less internal space defined by the electronic device during the non-operating state. For the operating state, the plug is expanded.

The electronic device equipped with the adjustable power plug of the instant disclosure comprises an adjustable power plug and a holder. The plug includes an insulating base, a pair of first pins, and a second pin. The insulating base has a main portion and a central portion movably engaged thereto. The main portion and the central portion may move linearly relative to each other. The first pins are arranged on the main portion, while the second pin is disposed on the central portion. When the main portion and the central portion move with respect to each other, the second pin remains parallel to the first pins in a direction along the long side of the pins. The first pins and the second pin may be arranged at an operating state or a non-operating state. The holder defines a receiving space for selectively accommodating the insulating base.

The instant disclosure has the following advantages. The first pins and the second pin may be arranged in an operating state or a non-operating state, while maintaining the current-carrying pins and the grounding pin parallel to one another. For the operating state, the second pin is moved away from the first pins. While for the non-operating state, the second pin is arranged in close to the first pins. When the main portion and the central portion move respect to each other, the second pin remains parallel to the first pins. Thus, the first and second pins may be linearly arranged to provide space-saving effect. In addition, the plug is structurally simple in saving manufacturing cost.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE EMBODIMENTS

Figure 1:
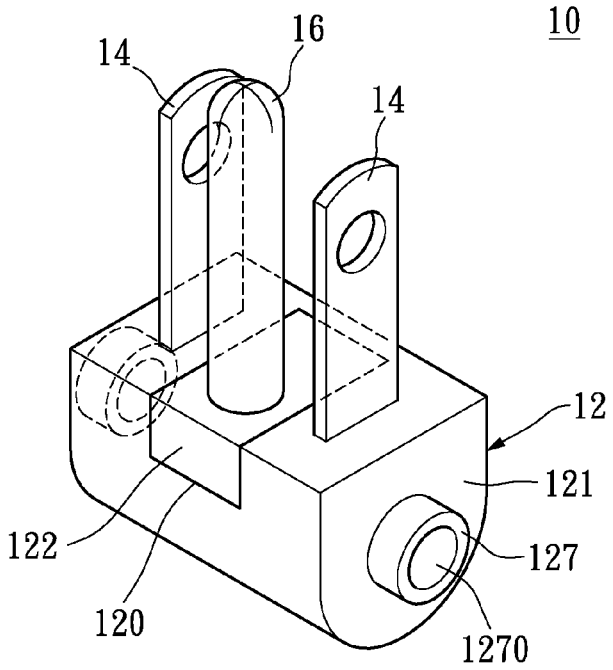
FIG. 1 is a perspective view showing a power plug of the instant disclosure arranged at the non-operating state.
Figure 2:
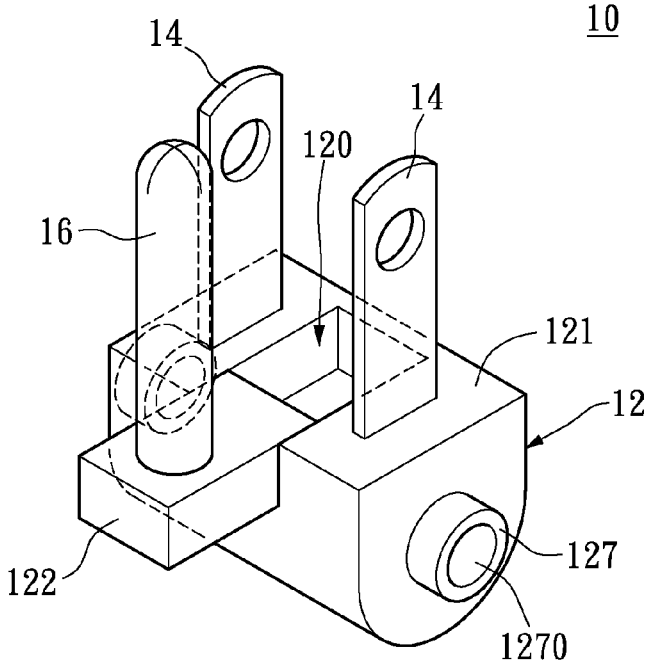
FIG. 2 is a perspective view showing the power plug in FIG. 1 arranged at the operating state.

Please refer to FIGS. 1 and 2, which show perspective views of an adjustable power plug 10 for a first embodiment of the instant disclosure. The plug 10 comprises an insulating base 12, a pair of first pins 14, and a second pin 16. For the instant embodiment, the first pins 14 are flat having a blade-like shape. One of the first pins 14 is a live pin, and the other being a neutral pin. The second pin 16 is a round grounding pin. However, the number of pins for the plug 10 is not restricted by the exemplary embodiment. For example, the plug 10 may only have two pins. Namely, the plug 10 has only one first pin 14 and one second pin 16.

The insulating base 12 has a main portion 121 and a central portion 122 engaged thereto. The main and central portions 121 and 122 may move linearly relative to each other. For the instant embodiment, the main portion 121 defines a slot 120. The central portion 122 is shaped to match the slot 120, where the central portion 122 is receivable by the slot 120 of the main portion 121.

The first pins 14 are disposed on the main portion 121, while the second pin 16 is disposed on the central portion 122. The second pin 16 may be screwed to the central portion 122. Such fixing method allows the second pin 16 to be removed if necessary. When the main portion 121 and the central portion 122 move respect to each other, the second pin 16 remains parallel to the first pins 14. Thus, depending on the user, the first pins 14 and the second pin 16 may be arranged at an operating state in a triangular pattern or at a non-operating state. One of the main technical features of the instant disclosure is that: while maintaining a parallel configuration between the current-carrying pins and the grounding pin (i.e., along the long side of the pins), the distance between the first pins 14 and the second pin 16 is reduced by the linear movement of the main portion 121 and the central portion 122 with respect to each other. Thus, when the plug 10 is no in use, the pins may be arranged in a substantially linear pattern to occupy less space. In addition, the plug 10 is structurally simple without utilizing complex components such as gears and driving mechanism to save manufacturing cost.

Moreover, the insulating base 12 may be further fitted with a pair connecting shafts 127 protruding from opposite sides thereof. The connecting shafts 127 are used for connecting to an electronic device, such as a transformer. Each connecting member 127 defines an axial bore 1270 for receiving at least one electrical wire. The first pins 14 may be connected to the wire (not shown), where the wire may extend externally of the plug 10 through the bore 1270.

Figure 3:
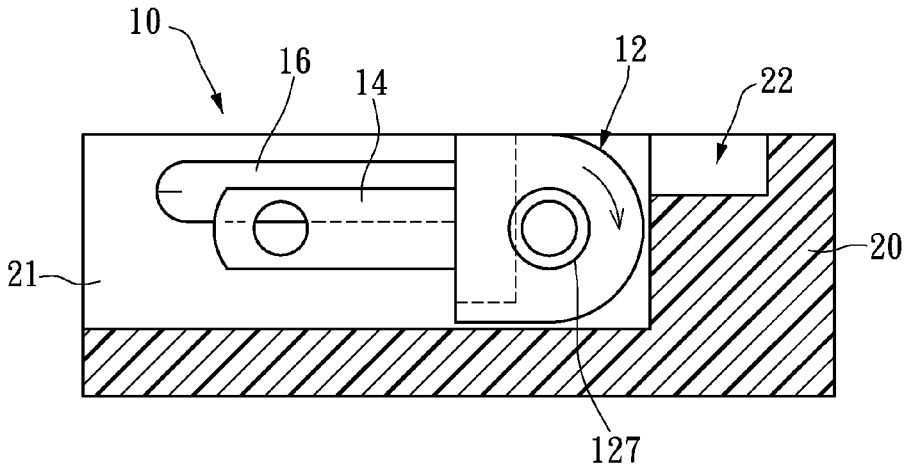
FIG. 3 is a cross-sectional view showing an electronic device equipped with the power plug for a first embodiment of the instant disclosure arranged at the non-operating state.
Figure 4:
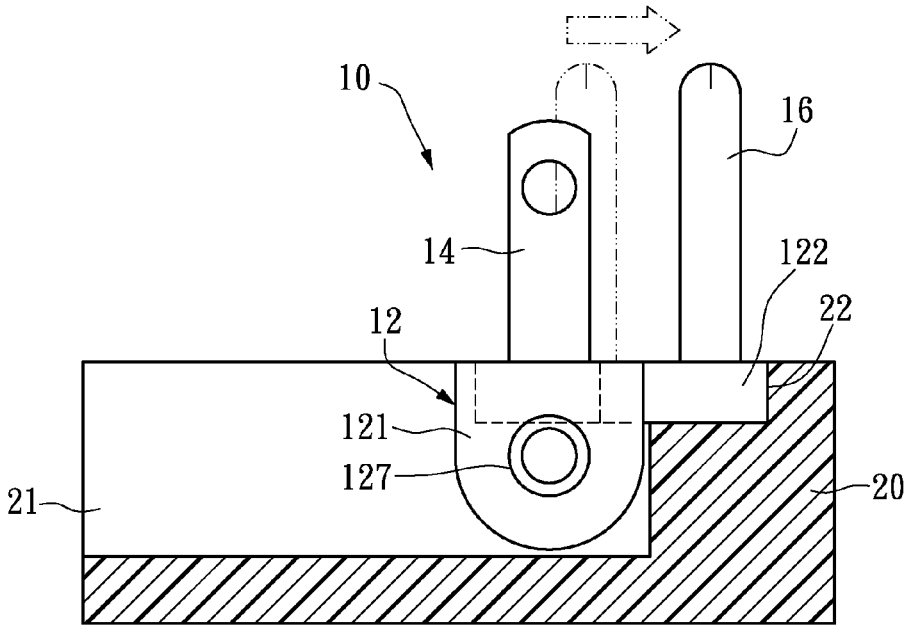
FIG. 4 is a cross-sectional view showing the electronic device in FIG. 3 arranged at the operating state.

Please refer to FIGS. 3 and 4, which are cross-sectional views showing an electronic device having the plug 10 of the instant disclosure. FIG. 3 is for non-operating state, while FIG. 4 is for operating state. In practice, the plug 10 may be adopted by electronic devices such as transformers, household appliances, electric razors, etc. A substantially rectangular holder 20 is shown in the figures as part of the electronic device. However, the exact shape and structural configuration of the holder 20 is not restricted by the exemplary embodiment.

The holder 20 defines a receiving space 21. The insulating base 12 may be movably arranged in the receiving space 21. As shown in FIG. 3, the insulating base 12 is pivotally arranged in the receiving space 21 through the connecting shafts 127. Also shown in FIG. 3, the first pins 14 and the second pin 16 are arranged close to one another in a substantially linear pattern and pivotally received by the receiving space 21. The holder 20 further defines an auxiliary space 22 in communication with the receiving space 21.

As shown in FIG. 4, when the plug 10 is pivoted upward, the plug 10 travels in a clock-wise direction. When the first pins 14 and the second pin 16 protrude upwardly from the receiving space 21, the auxiliary space 22 is used to accommodate the central portion 122. In other words, the second pin 16 is moved away from the first pins 14 in forming the triangular pattern for plugging to a receptacle. Alternatively, when the main portion 121 is allowed to move laterally, the auxiliary space 22 may be utilized for storing the main portion 121. Such configuration will be discussed in greater details hereinafter.

Figure 5:
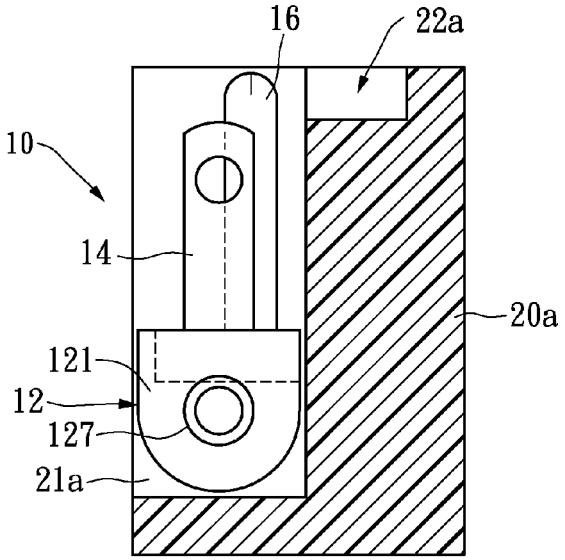
FIG. 5 is a cross-sectional view showing an electronic device equipped with the power plug for a second embodiment of the instant disclosure arranged at the non-operating state.
Figure 6:
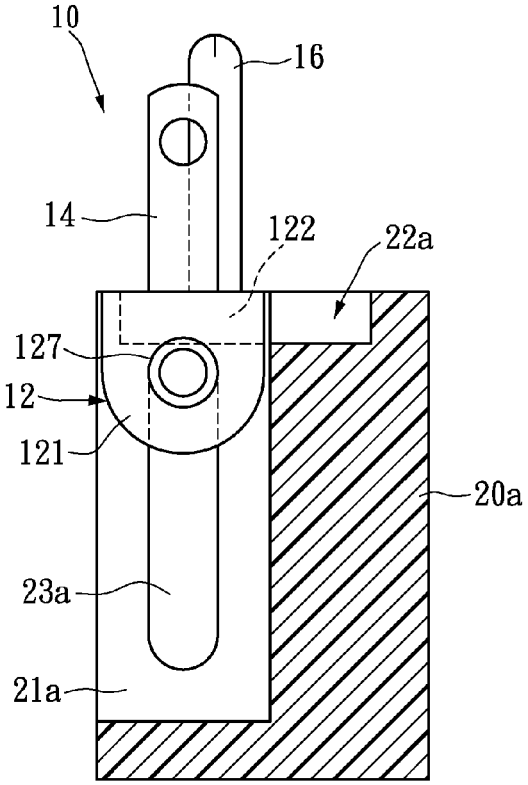
FIG. 6 is a cross-sectional view showing the electronic device in FIG. 5 arranged at an intermediate state.
Figure 7:
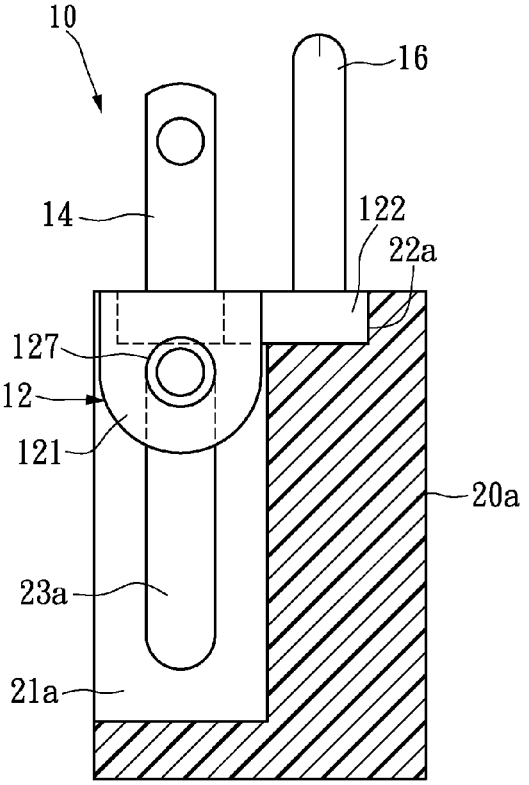
FIG. 7 is a cross-sectional view showing the electronic device in FIG. 5 arranged at the operating state.

Please refer to FIGS. 5~7, which show an electronic device of another embodiment equipped with the adjustable plug of the instant disclosure. For the instant embodiment, the first pins 14 and the second pin 16 may be substantially aligned linearly and drop downward into a receiving space 21*a* defined by a holder 20*a*. For example, at least a track 23*a* may be disposed on an inner wall of the receiving space 21*a* for guiding the insulating base 12 to move vertically through the connecting shafts 127. Thus, the insulating base 12 may traverse vertically inside the receiving space 21*a*. The holder 20*a* also defines an auxiliary space 22*a* in communication with the receiving space 21*a*.

Please refer to FIG. 6, which shows the plug 10 is configured protrudingly from the holder 20*a*. The plug 10 is first moved upward, where the first pins 14 and the second pin 16 remain in an aligned state. Next, please refer to FIG. 7. After the first pins 14 and the second pin 16 have been exposed protrudingly from the receiving space 21*a*, the second pin 16 is moved away from the first pins 14 parallelly. Thereby, the second pin 16 and the first pins 14 cooperatively define a triangular pattern for plugging to a receptacle. Correspondingly, the central portion 122 is accommodated by the auxiliary space 22*a*. Alternatively, when the main portion 121 is allowed to move laterally, the auxiliary space 22*a* may be utilized for storing the main portion 121. Such configuration will be discussed in greater details hereinafter.

Figure 8:
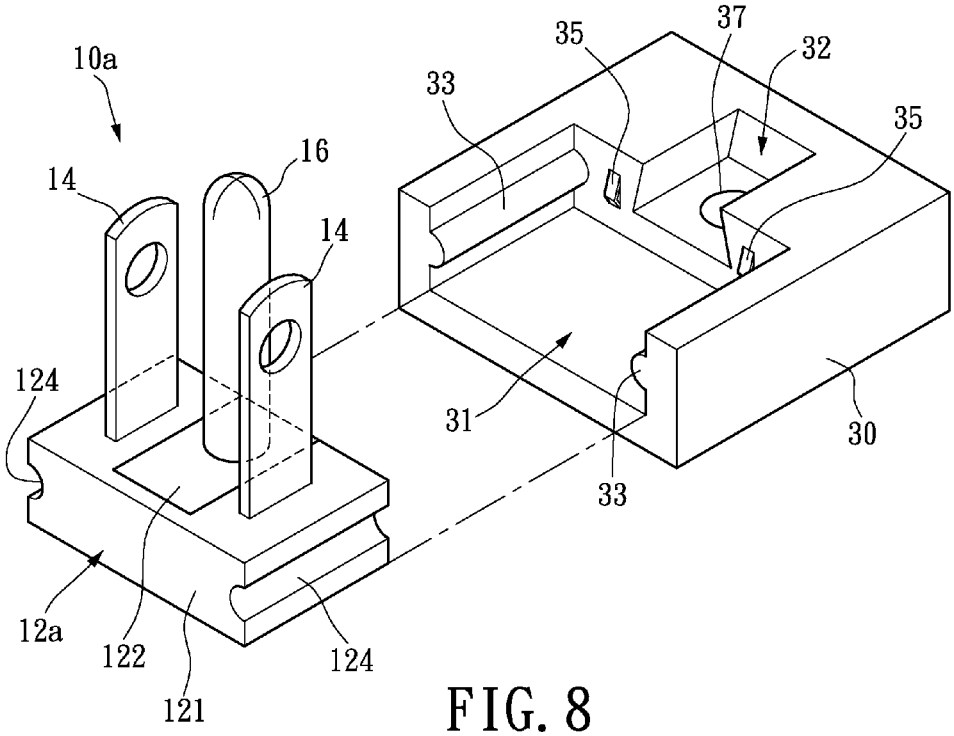
FIG. 8 is a perspective view showing an electronic device equipped with the adjustable power plug for a third embodiment of the instant disclosure.

Please refer to FIG. 8, which shows an electronic device of still another embodiment of the instant disclosure equipped with the adjustable power plug. For the instant embodiment, an adjustable power plug 10*a* is secured to a holder 30 of the electronic device by a snap-fit technique. Like previous embodiments, the holder 30 defines a receiving space 31 and an auxiliary space 32. The advantage of the instant embodiment is that the plug 10*a* now becomes replaceable. For example, different types of three-pin plug may be used for different region-based transformers and electronic devices. In particular, an insulating base 12*a* has a pair of connecting portions 124 formed on opposite sides thereof. In response, the holder 30 has a pair of engaging members 33 formed on opposite inner surfaces of the receiving space 31 for engaging the connecting portions 124. The connecting portions 124 are groove-shaped, while the engaging members 33 have a rib-like shape. However, the exact shapes of the connecting portions 124 and the engaging members 33 are not restricted. The important feature of the embodiment is that the connecting portions 124 and the engaging members 33 need to connect with each other securely.

For the instant embodiment, the holder 30 includes a pair of first contacts 35 inside the receiving space 31 for making electrical contact to the first pins 14 and a second contact 37 inside the auxiliary space 32 for making electrical contact to the second pin 16. The location of the first contacts 35 is not restricted. For example, the first contacts 35 may protrude upwardly from a bottom surface that defines the receiving space 31 according to a different design. For such configuration, the first pins 14 are exposed from the bottom surface of the insulating base 12*a* for contacting the first contacts 35.

Figure 9:
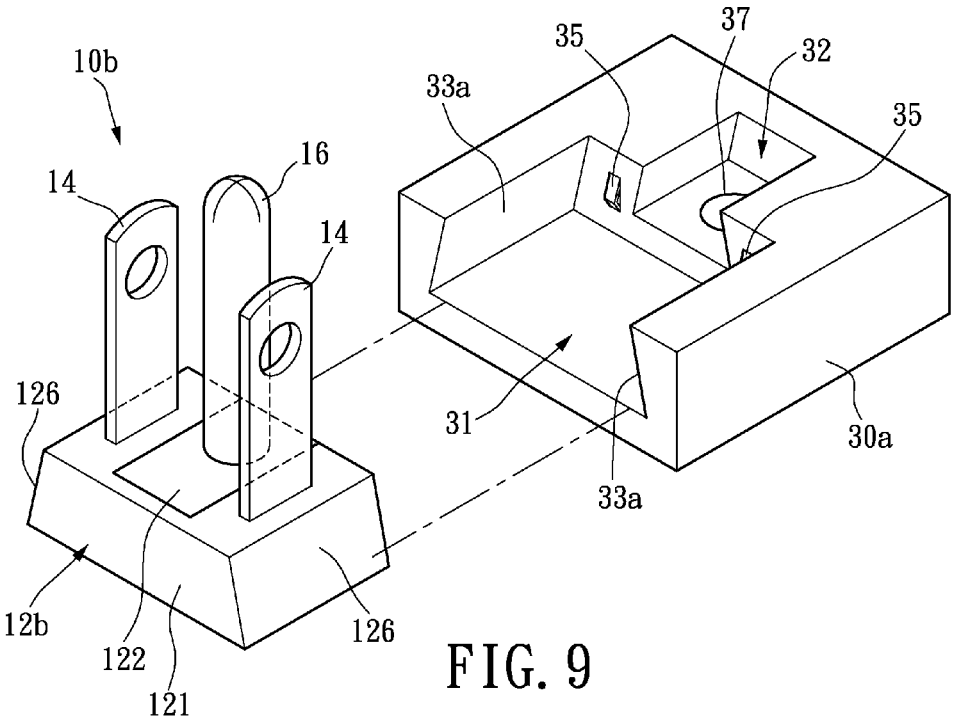
FIG. 9 is a perspective view showing an electronic device equipped with the adjustable power plug for a fourth embodiment of the instant disclosure.

Please refer to FIG. 9, which shows an electronic device in yet another embodiment of the instant disclosure equipped with an adjustable power plug 10*b*. The power plug 10*b* includes an insulating base 12*b*. In comparing to FIG. 8, the insulating base 12*b* has a pair of sloped connecting portions 126 formed on opposite sides thereof. A corresponding holder 30*a* also has a pair of sloped engaging members 33*a*. The sloped construction of the insulating base 12*b* and the holder 30*a* also allows securing the plug 10*a* to the holder 30*a*.

Figure 10:
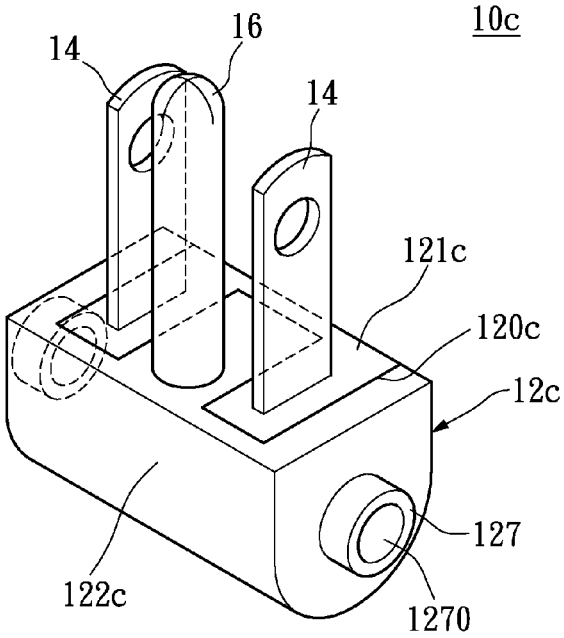
FIG. 10 is a perspective view showing an adjustable power plug of another embodiment of the instant disclosure arranged at the non-operating state.
Figure 11:
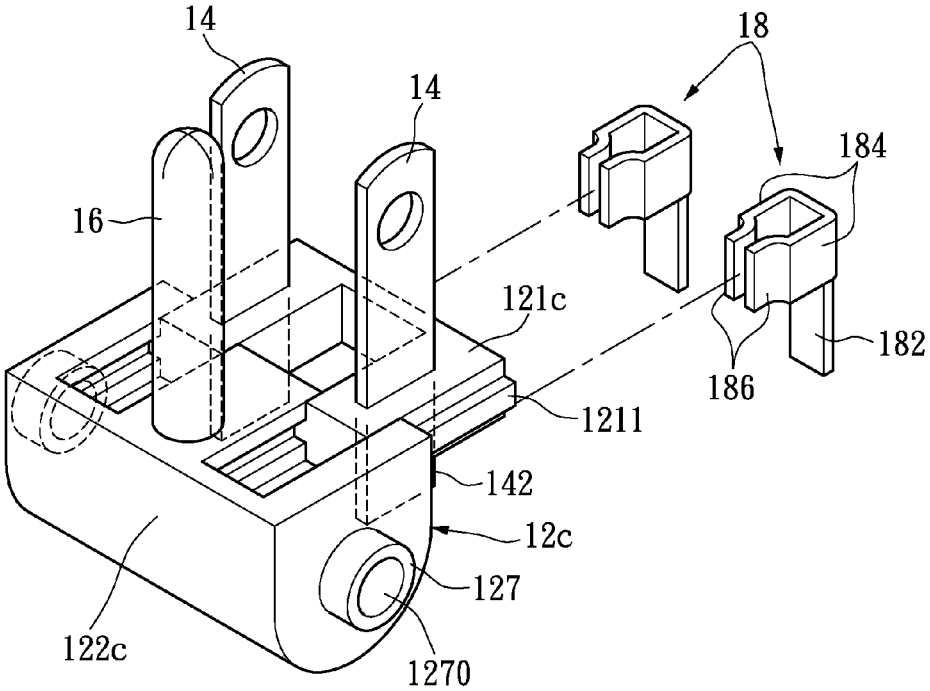
FIG. 11 is a perspective view showing the adjustable power plug in FIG. 10 arranged at the operating state.

Please refer to FIGS. 10 and 11, which show a plug 10*c* for another embodiment of the instant disclosure. The plug 10*c* includes an insulating base 12*c*, which has a movable main portion 121*c* fitted with the first pins 14. The insulating base 12*c* further has a central portion 122*c* defining a slot 120*c*. The main portion 121*c* is shaped matchingly to the slot 120*c* and may be movably engaged thereto. The slot 120*c* is substantially U-shaped but is not restricted thereto. For example, the slot 120*c* may be semi-circular shaped or take on any other shape.

Please refer to FIG. 11, where the inner surfaces that define the slot 120*c* are groove-shaped. A pair of ridges 1211 is formed on opposite sides of the main portion 121*c* for engaging the groove-shaped inner surfaces of the slot 120*c*. The instant embodiment also provides a pair of intermediate contacts 18. After the first pins 14 are moved away from the second pin 16, the intermediate contacts 18 receive the first pins 14 to conduct power. Each intermediate contact 18 has a base portion 182 and a pair of arms 184. Each arm 184 has a contacting portion 186 for contacting a bottom end portion 142 of the corresponding first pin 14.

Based on the foregoing, the instant disclosure has the following advantages. The instant disclosure provides the adjustable power plug having at least two pins. For the three-pin configuration, the second pin 16 remains parallel to the first pins 14 during the linear displacement. Thus, the first pins 14 and the second pin 16 may be arranged at the operating or non-operating state. When the plug is not in use, the pins may be substantially aligned linearly to occupy less space. In addition, the plug is structurally simple without using complex components, thus the plug is cost-effective. Moreover, the electronic device equipped with adjustable power plug requires less space for storing the plug, since the first pins 14 and the second pin 16 of the plug 10 may be arranged substantially in a linear pattern to save space. The storing method includes the pivoting and vertical displacement techniques.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. An adjustable power plug, comprising:

an insulating base having a main portion and a central portion movably engaged thereto, the main portion and the central portion being linearly movable with respect to each other;

at least one first pin disposed on the main portion; and a second pin disposed on the central portion, wherein when the main portion and the central portion move with respect to each other, the second pin remains parallel to the first pin and cooperatively define an operating state and a non-operating state, and the second pin and the first pin belong to the same plug.

2. The adjustable power plug of claim 1, wherein the second pin is screwed to the central portion.

3. The adjustable power plug of claim 1, wherein the insulating base has a pair of connecting shafts formed on opposite sides thereof.

4. The adjustable power plug of claim 3, wherein each connecting shaft defines an axial bore.

5. The adjustable power plug of claim 3, wherein the main portion defines a slot engageable by the central portion.

6. The adjustable power plug of claim 3, wherein a slot is formed on the central portion engageable by the main portion, and wherein the main portion is shaped matchingly to the slot.

7. The adjustable power plug of claim 6, further comprising at least one intermediate contact for engaging the first pin after the first pin has been displaced away from the second pin.

8. The adjustable power plug of claim 1, wherein the insulating base has a pair of connecting portions formed on opposite sides thereof, and wherein the connecting portions enable the insulating base to be removably connected to an electronic device.

9. The adjustable power plug of claim 8, wherein each connecting portion has a groove-like shape or a sloped shape.

10. The adjustable power plug of claim 1, wherein the first and the second pins are arranged close to or away from one another.

11. An electronic device, comprising:

an adjustable power plug, comprising:

an insulating base having a main portion and a central portion movably engaged thereto, the main portion and the central portion being linearly movable with respect to each other;

at least one first pin disposed on the main portion;

a second pin disposed on the central portion, wherein when the main portion and the central portion move with respect to each other, the second pin remains parallel to the first pin and cooperatively define a plugging state or a non-plugging state, and the second pin and the first pin belong to the same plug; and a holder defining a receiving space, the insulating base being movably disposed in the receiving space.

12. The electronic device of claim 11, wherein the insulating base has a pair of connecting shafts arranged on opposite sides thereof, wherein the connecting shafts allow the insulating base to be disposed pivotally inside the receiving space, wherein the holder further defines an auxiliary space in communication with the receiving space, and wherein when the first and second pins are exposed protrudingly from the receiving space, the main portion or the central portion is accommodated by the auxiliary space.

13. The electronic device of claim 11, wherein the insulating base is capable of displacing vertically inside the receiving space, wherein the holder further defines an auxiliary space in communication with the receiving space, and wherein when the first and second pins are exposed protrudingly from the receiving space, the main portion or the central portion is accommodated by the auxiliary space.

14. The electronic device of claim 13, wherein the insulating base has a pair of connecting portions formed on opposite sides thereof, and wherein the holder has a pair of engaging members formed on opposite inner walls of the receiving space for engaging the connecting portions.

15. The electronic device of claim 12, wherein the holder further comprises:

at least one first contact disposed inside the receiving space for making electrical contact to the first pin; and a second contact disposed inside the auxiliary space for making electrical contact to the second pin.

16. The electronic device of claim 13, wherein the holder further comprises:

at least one first contact disposed inside the receiving space for making electrical contact to the first pin; and a second contact disposed inside the auxiliary space for making electrical contact to the second pin.

17. A holder, for receiving an adjustable power plug having a main portion and a central portion, with the main portion and the central portion being linearly movable relative to each other, comprising:

a receiving space shaped matchingly to the main portion of the plug, the main portion being movably disposed in the receiving space;

an auxiliary space in communication with the receiving space and shaped matchingly to the central portion of the plug, the central portion being movably disposed in the auxiliary space;

at least one first contact disposed in the receiving space; and a second contact disposed in the auxiliary space.

18. The electronic device of claim 11, wherein the first and the second pins are arranged close to or away from one another.

* * * * *